US009380871B2

(12) United States Patent
Shepherd

(10) Patent No.: US 9,380,871 B2
(45) Date of Patent: Jul. 5, 2016

(54) TABLE WITH INNER ROW SEATING

(71) Applicant: Roger Paul Shepherd, Apopka, FL (US)

(72) Inventor: Roger Paul Shepherd, Apopka, FL (US)

( * ) Notice: Subject to any disclaimer, the term of this patent is extended or adjusted under 35 U.S.C. 154(b) by 60 days.

(21) Appl. No.: 14/508,258

(22) Filed: Oct. 7, 2014

(65) Prior Publication Data

US 2015/0097398 A1 Apr. 9, 2015

Related U.S. Application Data

(60) Provisional application No. 61/961,169, filed on Oct. 7, 2013.

(51) Int. Cl.
*A47B 83/02* (2006.01)
*A47B 37/04* (2006.01)
*A47B 3/00* (2006.01)

(52) U.S. Cl.
CPC . *A47B 83/02* (2013.01); *A47B 3/00* (2013.01); *A47B 37/04* (2013.01)

(58) Field of Classification Search
USPC ..... 297/136, 121, 122, 157.1, 158.3, 158.5, 297/119; 108/64–66, 99, 101, 152, 157, 108/159, 155
See application file for complete search history.

(56) References Cited

U.S. PATENT DOCUMENTS 1,951,619 A * 3/1934 MacDonald ..... A47B 83/02 108/101
2,713,889 A 7/1955 White
3,366,415 A 1/1968 Cooper
3,706,471 A * 12/1972 Shimosawa ..... A47B 83/02 297/158.1
4,237,796 A 12/1980 Gordon et al.
D266,211 S 9/1982 Thom et al.
D276,764 S 12/1984 Shipman et al.
4,569,555 A * 2/1986 Lehman ..... A47B 83/02 108/159
D315,254 S 3/1991 Walters
5,027,718 A 7/1991 Graham, Sr.
5,720,512 A 2/1998 Hostetler
5,799,587 A * 9/1998 Branch ..... A47F 5/10 108/66
5,921,622 A 7/1999 Newton
6,032,590 A * 3/2000 Chen ..... A47B 3/06 108/158.12
6,070,936 A 6/2000 Holland
6,832,561 B2 12/2004 Johnson
6,878,026 B2 * 4/2005 Cloutier ..... A47B 37/04 297/158.3
7,004,082 B2 * 2/2006 Yang ..... A47B 37/04 108/50.12
8,997,661 B1 * 4/2015 Kilday ..... A47B 13/088 108/50.12
2003/0230223 A1 * 12/2003 Dodd ..... A47B 83/02 108/186
2004/0036324 A1 * 2/2004 Johnson ..... A47B 9/00 297/158.5

* cited by examiner

*Primary Examiner* — Timothy J Brindley

(57) ABSTRACT

A table having inner row seating comprising a table top having a central opening, outer seating, a center mounting assembly and inner seat positioned on center mounting assembly. The inner seat provides inner row seating for children. Table top and outer seating both have removable portions that provide entry into inner central opening where inner seat is located. A revolving tray and or umbrella can also be added to the table when the inner seat is not in use.

10 Claims, 23 Drawing Sheets

TABLE WITH INNER ROW SEATING

CROSS-REFERENCE TO RELATED APPLICATION

This application claims priority to U.S. Provisional Application No. 61/961,169, entitled, "Picnook table", filed Oct. 7, 2013, which is hereby incorporated by reference herein in its entirety.

FIELD OF INVENTION

The present disclosure generally relates to a table; more specifically, to a table with inner row seating having a closeable opening to provide entry into the inner row seating.

BACKGROUND

Picnic tables come in various shapes and sizes. Picnic tables are generally rectangular in shape and have a rectangular table top and a row of seating on each side of the table top. Picnic tables can also be circular or polygonal in shape and have a circular or polygonal table top with a row of seating about the perimeter. These picnic tables offer limiting seating about the perimeter of the table. In addition, because picnic tables are often sized for adults, children can have difficulty sitting at picnic tables because they cannot rest their feet on the ground while seated.

Picnic tables, due to their bulkiness, are also difficult to transport. Even if the elements of the tables are disassembled for transport, some of the pieces are large enough to take up a considerable amount of room. Many pieces are often awkwardly shaped, making efficient, space-minimizing packing difficult and time consuming if not impossible.

SUMMARY

In accordance with the teachings disclosed herein, embodiments related to a table having inner row seating are disclosed.

In an embodiment, the table comprises a plurality of table top portions, a plurality of substantially vertical table top braces, a plurality of substantially horizontal seat braces, a plurality of outer seat portions, and a center mounting assembly. The table top portions are assembled into a table top having a central opening. At least one of the table top portions is removable from the table top. The substantially vertical table top braces are in communication with the table top portions and the substantially horizontal seat braces. The outer seat portions are assembled into an outer seat. At least one of the outer seat portions is removable from the outer seat. The outer seat portions are in communication with the horizontal seat braces. The center mounting assembly is substantially centered within the substantially vertical table top braces and is also in communication with the substantially horizontal seat braces.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
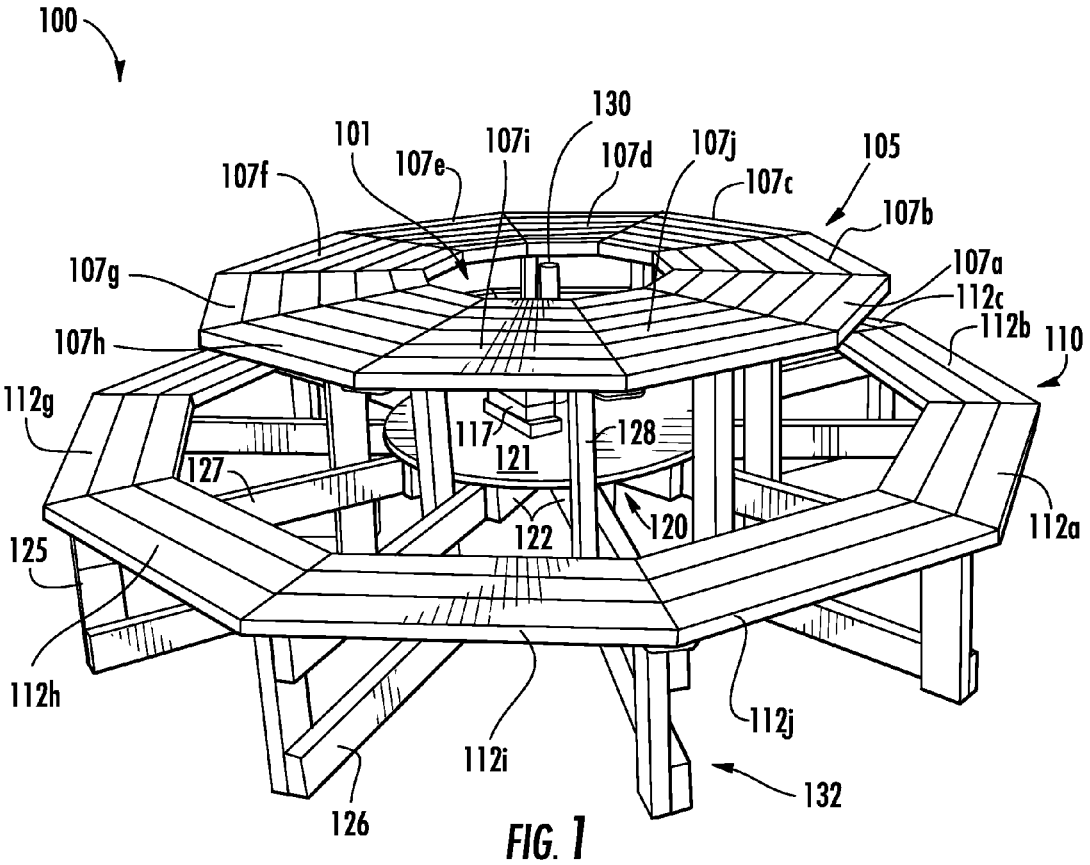
FIG. 1 is a perspective view of a table having inner row seating according to an embodiment of the present invention.
Figure 2:
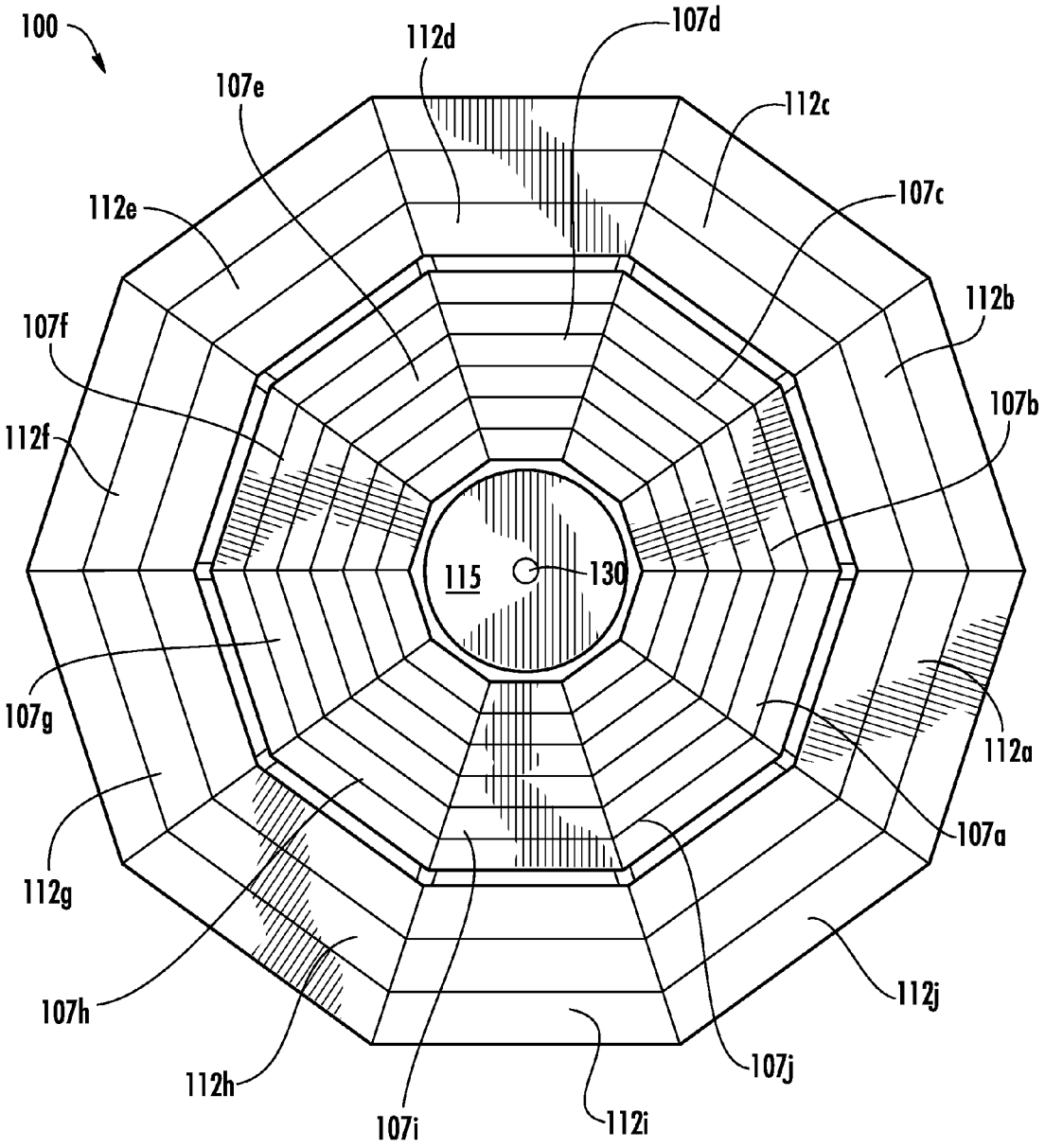
FIG. 2 is a top plan view of the table having inner row seating shown in FIG. 1.
Figure 3:
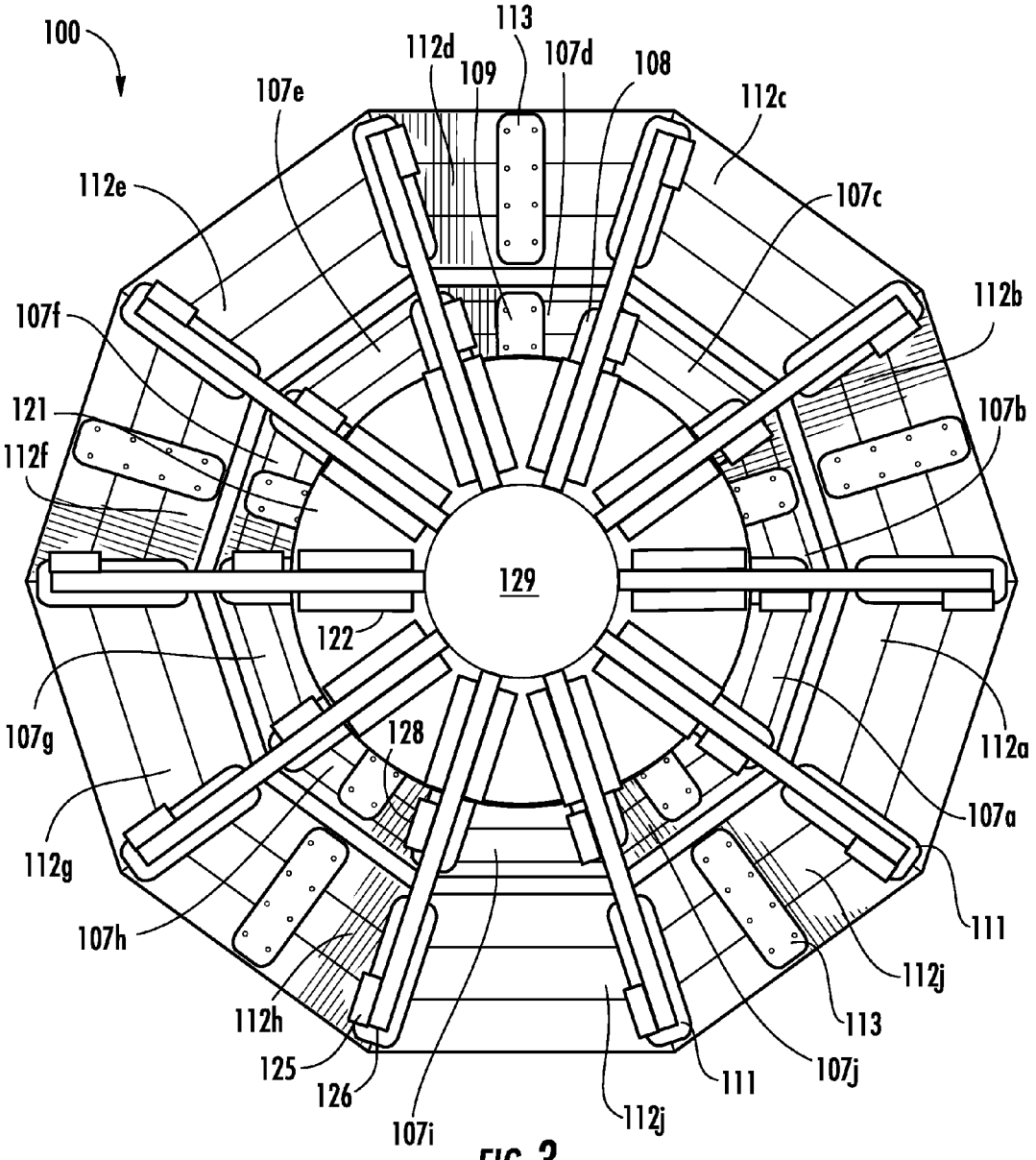
FIG. 3 is a bottom plan view of the table having inner row seating shown in FIG. 1.

A detailed description of embodiments for a table with inner row seating will now be presented with reference to FIGS. 1-29. One of skill in the art will recognize that these embodiments are not intended to be limitations on the scope, and that modifications are possible without departing from the spirit thereof. In certain instances, well-known methods, procedures and components have not been described in detail.

Although referred to occasionally herein as a picnic table, embodiments of the invention are not limited to a picnic table. The invention contemplates any utility table.

Referring now to the drawings, in particular to FIGS. 1 through 4, there is shown table 100 generally comprising table top 105 having central opening 101, outer seating 110, center mounting assembly 120, and inner seat 115 positioned on center mounting assembly 120. Inner seat 115 provides inner row seating for children.

Figure 4:
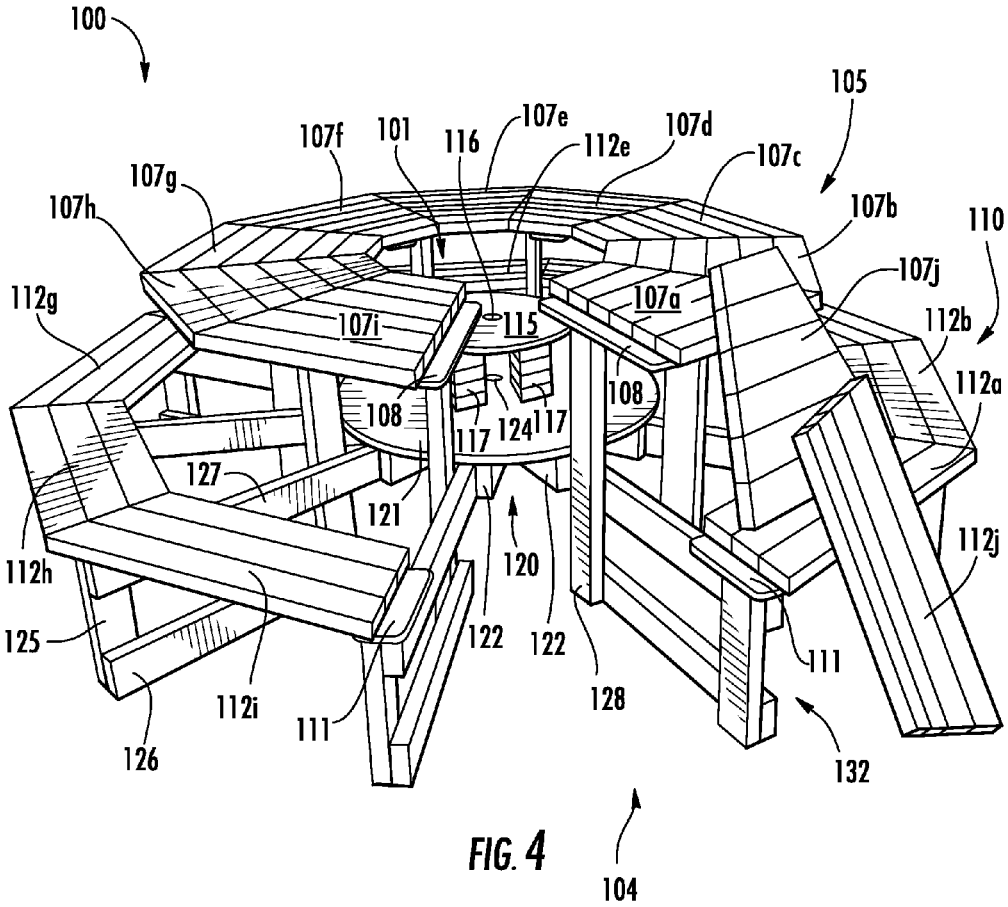
FIG. 4 is a perspective view of the table with inner row seating shown in FIG. 1 illustrating an entry opening to the inner row seating according an embodiment of the present invention.

Table top 105 comprises table top portions 107*a-j* and outer seating 110 comprises outer seat portions 112*a*-112*j*. Each of table top portions 107*a*-107*j* are substantially identical in size and shape and each of outer seat portions 112*a*-112*j* are substantially identical in size and shape. One or more of table top portions 107*a*-107*j* and one or more of outer seat portions 112*a*-112*j* can be removable to provide access to the inner row seating. FIG. 4 illustrates table top portion 107*j* and outer seat portion 112*j* removed to provide entry 104 to access the center of table 100. Each of table top portions 107*a*-107*j* and outer seat portions 112*a*-112*j* are generally trapezoidal in shape.

The embodiment of table 100 is in the shape of a decagon; however, other polygonal shapes, such as, for example, triangles, quadrilaterals, pentagons, hexagons, heptagons, octagons, and nonagons can be used. For each polygonal shape, the table top portions and the outer seat portions can remain generally trapezoidal; however, the length of the sides and size of the angles of the trapezoid will vary with each polygonal shape. Alternatively, the non-abutting edges the table top portions and the outer seat portions can be rounded to create a circular-shaped table or take on other alternative shapes. The size and shape of each of the table top portions in any given table can be substantially the same. Likewise, the size and shape of each of the outer seat portions in any given table can be substantially the same. The size and shape of center mounting assembly may vary depending on the polygonal shape used and the number and size of the braces (including, for example, brace positioning members, upper and lower horizontal braces, vertical seat braces, and vertical table braces, which are further described below) may vary as well.

The elements that comprise table 100 are shown in and described with reference to FIGS. 5 through 15. Table 100 is constructed from a number of separate elements to aid in transport. Instead of having to transport a bulky table of significant size and weight, the separate elements are sized and shaped to stack in a space-minimizing manner.

Figure 5:
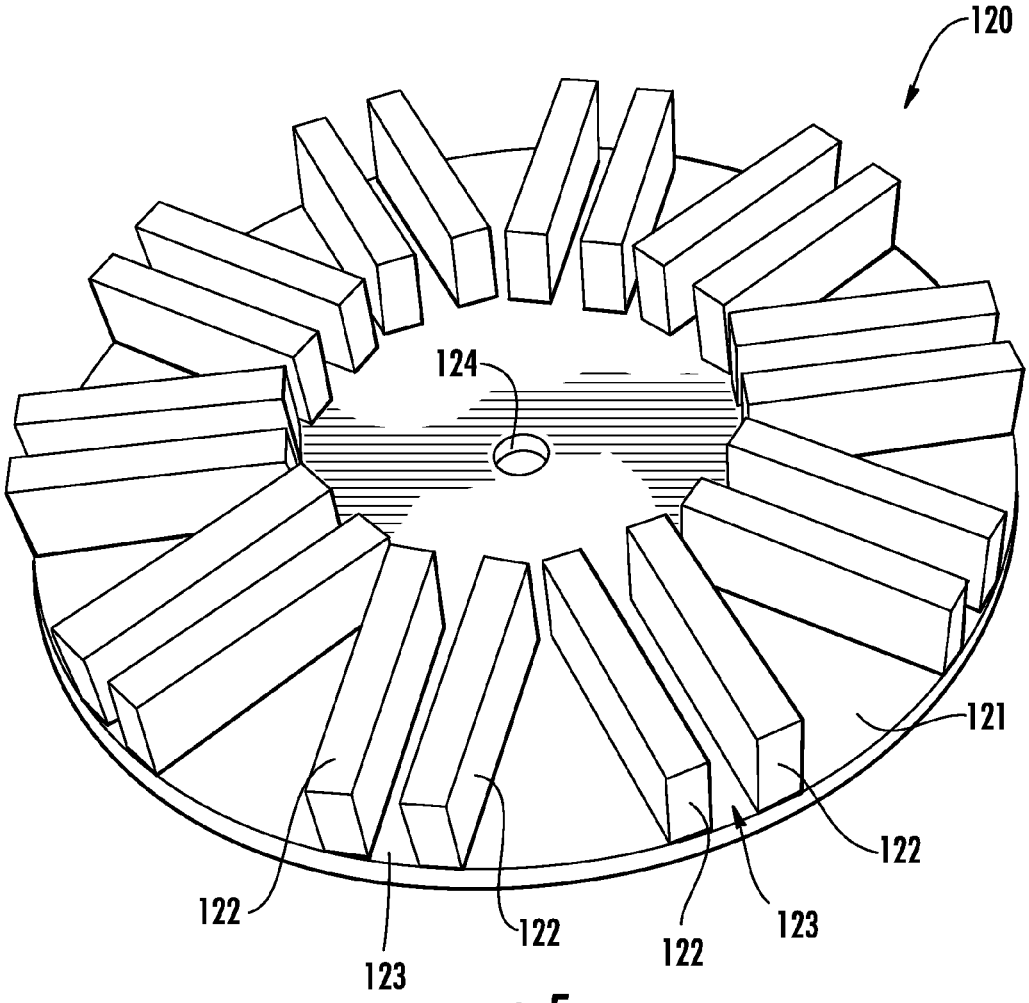
FIG. 5 is a perspective view of the bottom side of a center mounting assembly according to an embodiment of the present invention.

Center mounting assembly 120, shown from its bottom (ground-facing) side in FIG. 5, comprises mounting assembly top 121 having mounting assembly top opening 124 positioned substantially near the center of mounting assembly top 121 and brace positioning members 122 rigidly affixed thereon. Pairs of brace positioning members 122 are spaced to create brace receiving slots 123. Pairs of brace positioning members 122 are positioned on mounting assembly top 121 so that the length of receiving slots 123 are substantially perpendicular to the perimeter of mounting assembly top 121 and substantially equally spaced along the perimeter of mounting assembly top 121.

Figure 6:
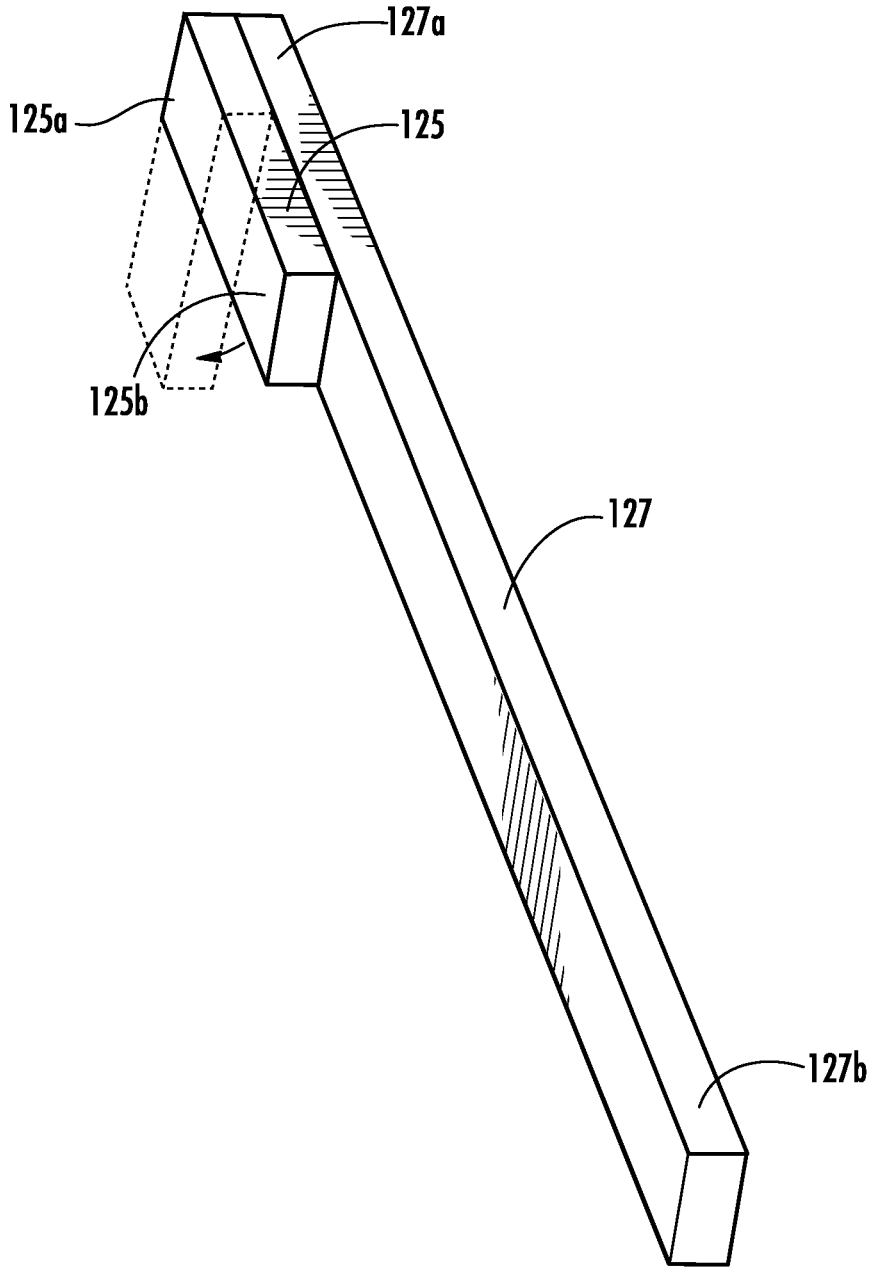
FIG. 6 is a perspective view of a portion of the seat brace comprising an upper horizontal seat brace and a vertical seat brace according to an embodiment of the present invention.

A portion of seat brace 132 (FIGS. 1 and 4) comprising vertical seat brace 125 and upper horizontal seat brace 127 is shown in FIG. 6. For transport and storage, vertical seat brace 125 and upper horizontal seat brace 127 can be rotatably attached at vertical seat brace's first end 125*a* and upper horizontal seat brace's first end 127*a* such that vertical seat brace 125 and upper horizontal seat brace 127 can rotate at least between zero degrees) (0° (retracted position) and ninety degrees)(90° (extended position) with respect to each other. For transport and storage, vertical seat bracket 125 and upper horizontal seat brace 127 can be kept in the retracted position. In use, an end of vertical seat brace 125 is rigidly affixed to an end of upper horizontal seat brace 127 in the extended position.

Figure 16:
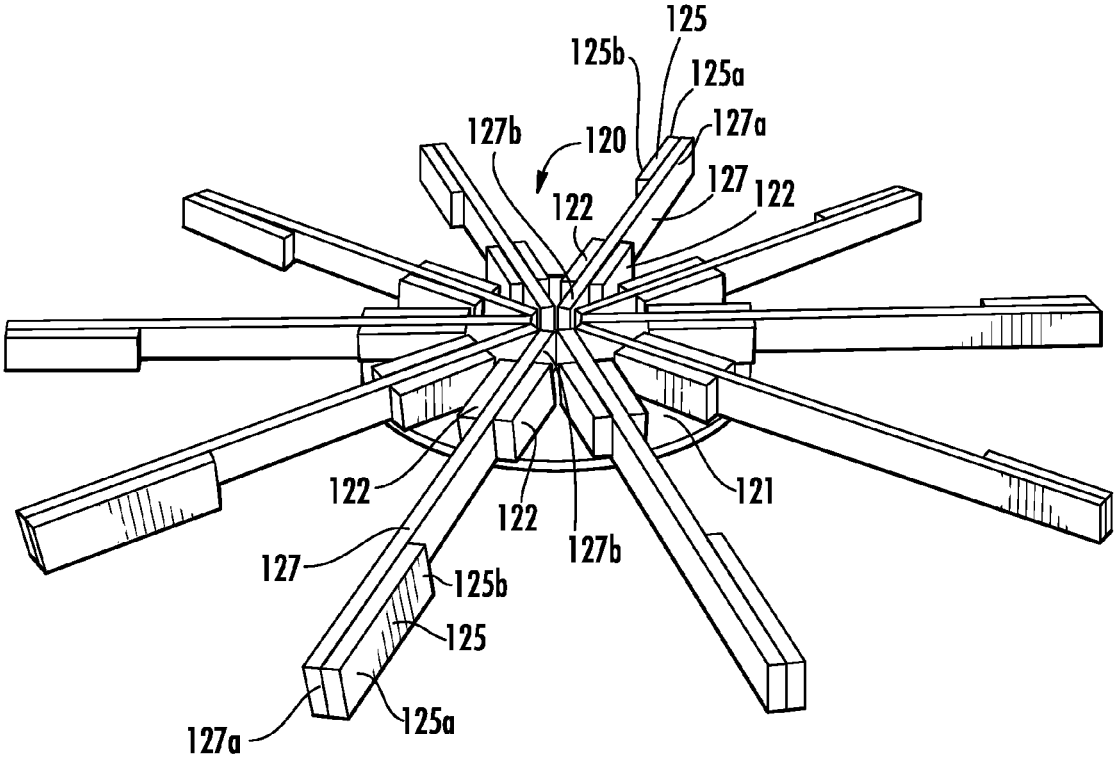
FIG. 16 is a bottom-side perspective view of the upper horizontal seat brace of FIG. 6 fitted into the brace position members of the center mounting assembly of FIG. 5 according to an embodiment of the present invention.

For assembly, as shown in FIG. 16, second ends 127*b* of upper horizontal seat braces 127 are positioned and secured in brace receiving slots 123 of center mounting assembly 120. Although second ends 127*b* of upper horizontal seat braces 127 are shown to extend past brace positioning members 122 toward the center of center mounting assembly 120, such extension is optional.

Figure 7:
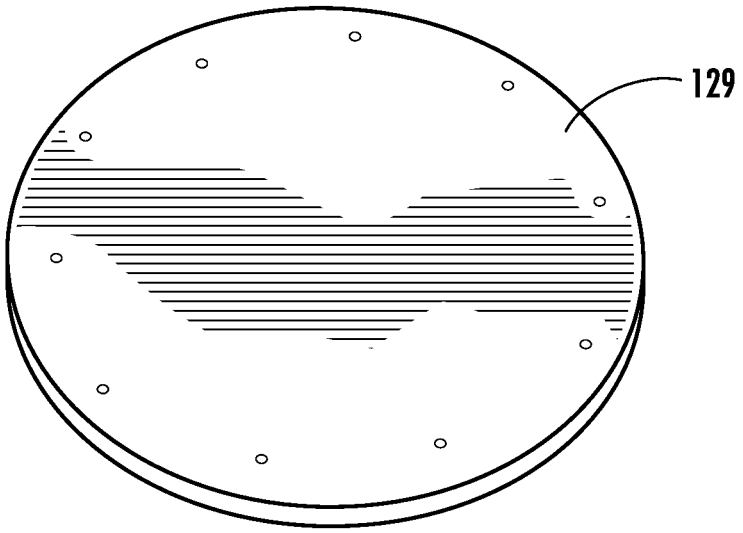
FIG. 7 is a perspective view of a center mounting assembly base according to an embodiment of the present invention.
Figure 17:
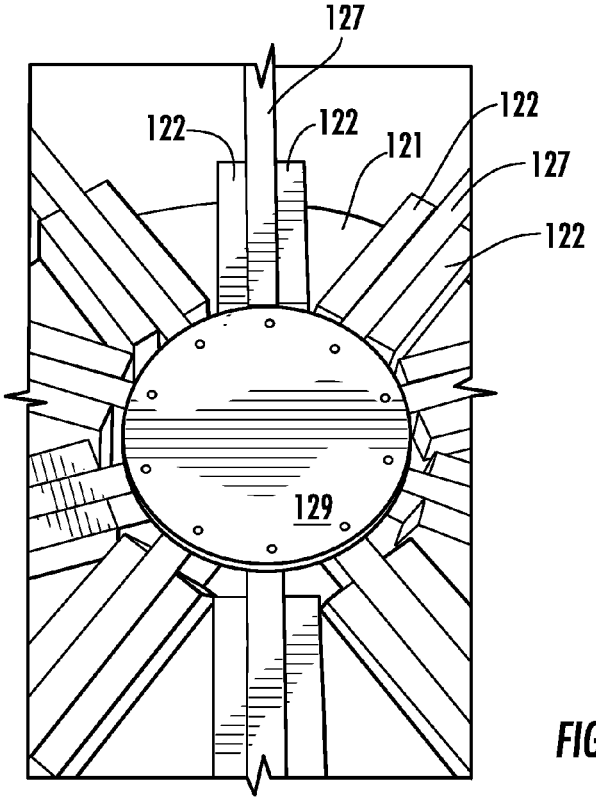
FIG. 17 is a bottom-side perspective view of the upper horizontal seat brace fitted into the brace position members of the center mounting assembly of FIG. 16 secured together with the center mounting assembly base of FIG. 7 according to an embodiment of the present invention.

Mounting assembly base 129 is shown in FIG. 7. Mounting assembly base 129 is optional, but useful for certain other features that require the use of dowel 130 or a similar element, as described further below. Mounting assembly base 129 can be affixed to second ends 127*b* of upper horizontal seat braces as shown in FIG. 17. Alternatively, if a larger mounting assembly base is used, it can be attached to upper horizontal seat braces 127.

Figure 18:
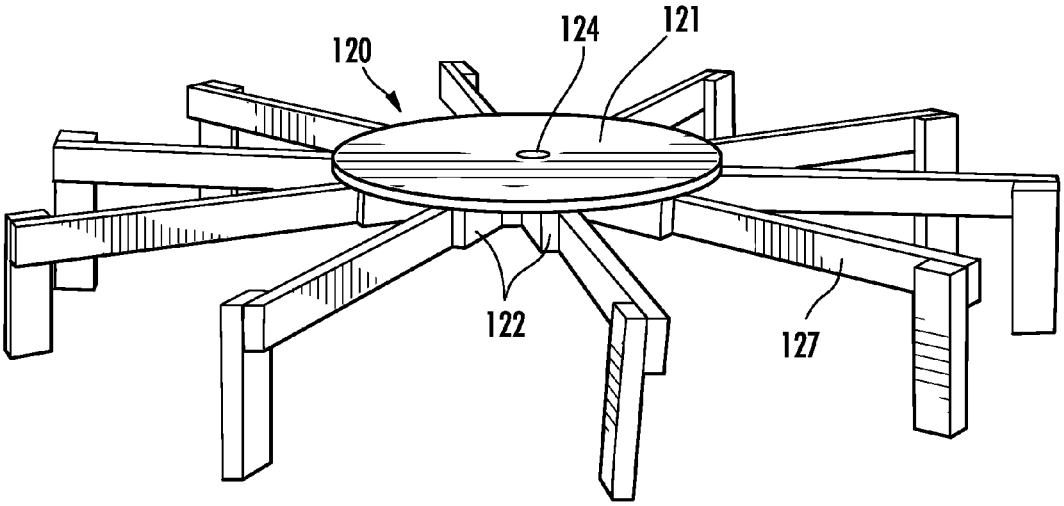
FIG. 18 is a perspective view of the top side of the assembly of FIG. 17 with the vertical seat brace extended in to a substantially ninety degree angle according to an embodiment of the present invention.

Center mounting assembly 120 with vertical seat braces 125 connected thereto is shown in FIG. 18 in an upright position. Vertical seat braces 125 are in their extended position.

Figure 8:
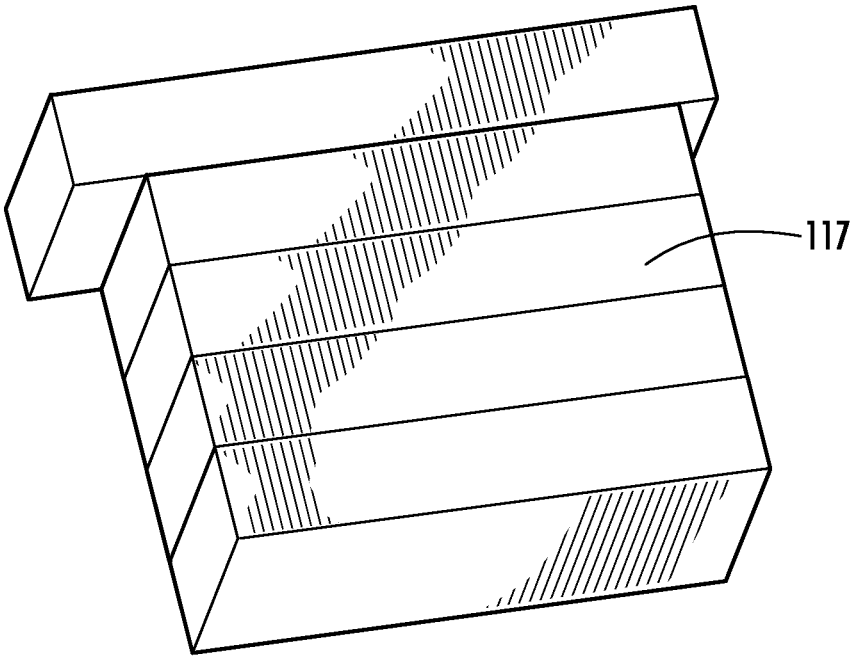
FIG. 8 is a perspective view of a seat mount according to an embodiment of the present invention.
Figure 19:
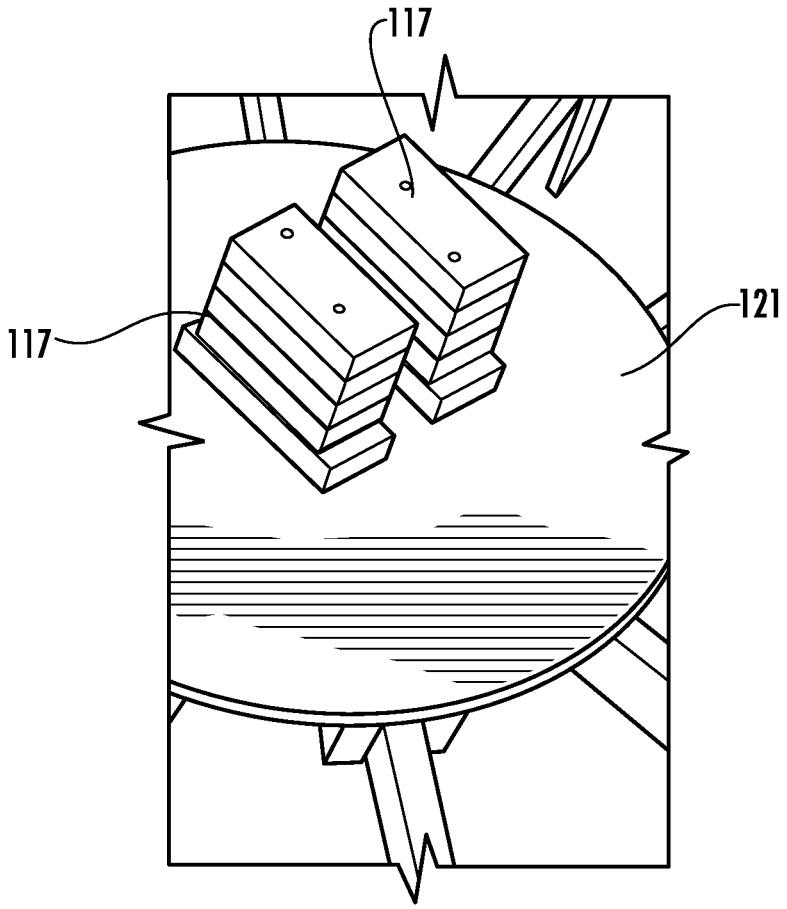
FIG. 19 is a perspective view of the assembly of FIG. 18 with the seat mounts of FIG. 8 secured thereon according to an embodiment of the present invention.

Seat mount 117 is shown in FIG. 8. For assembly, as illustrated in FIG. 19, seat mounts 117 are affixed to mounting assembly top 121 on opposite sides of mounting assembly top opening 124. Seat mount 17 can vary in shape and size. Seat mount 117, as shown, includes protrusions on the portion of seat mount 117 that abuts mounting assembly top 121. Such protrusions can aid in affixing seat mount 117 to mounting assembly top 121, for example, when screws are used to mount two wood pieces; however, such protrusions may not be needed for other types of materials or other affixing means.

Figure 9:
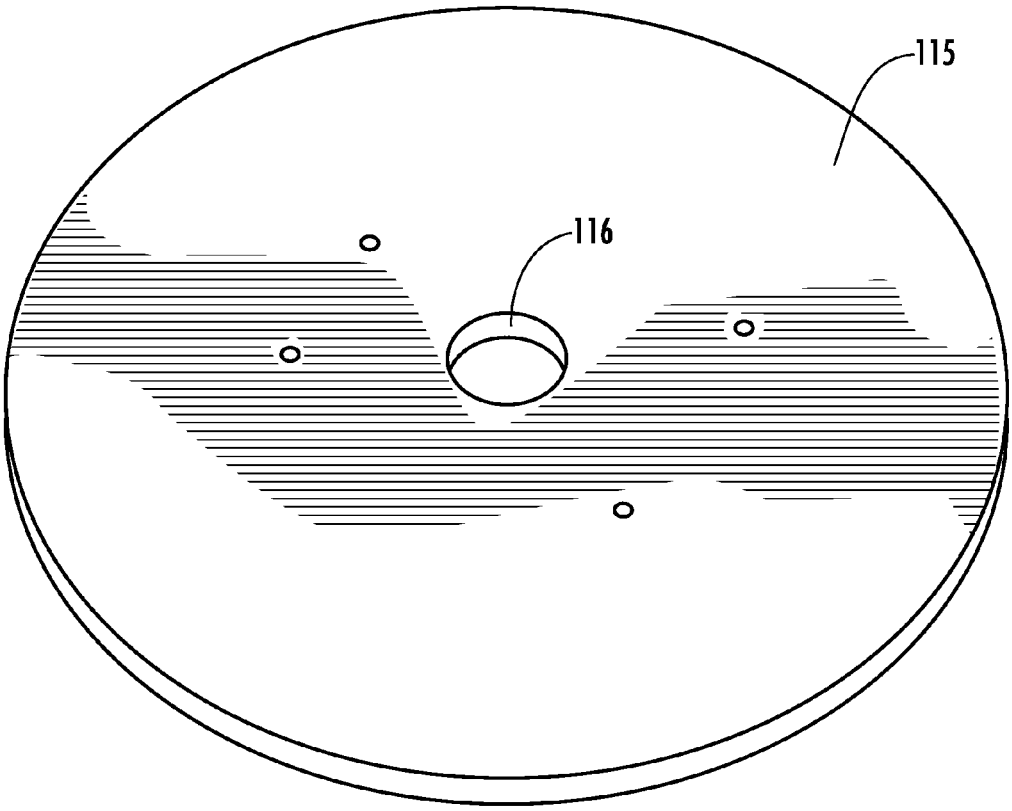
FIG. 9 is perspective view of an inner seat according an embodiment of the present invention.
Figure 10:
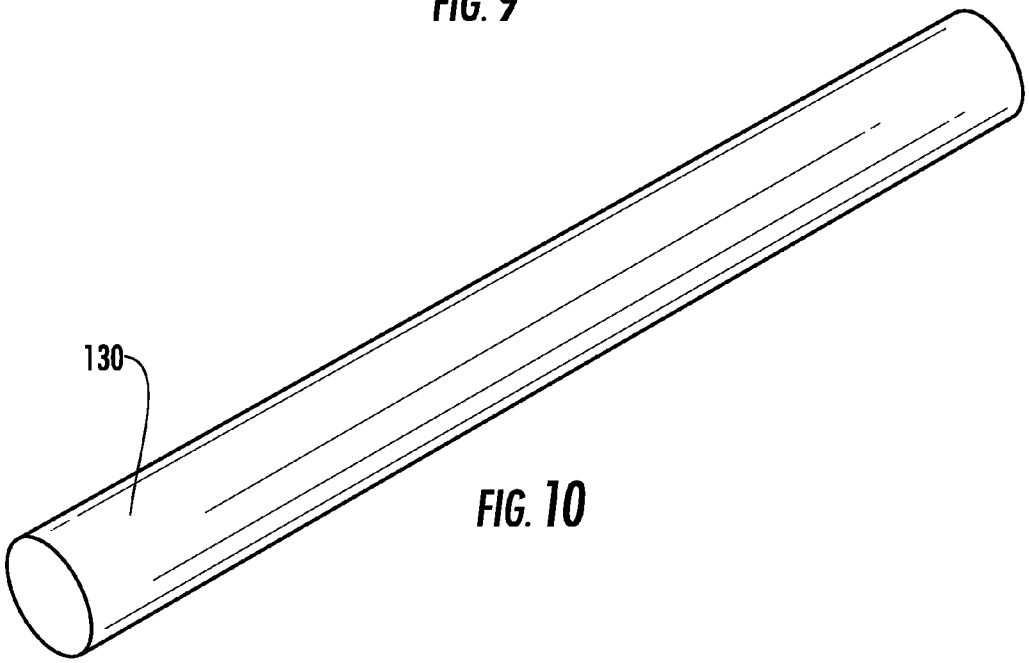
FIG. 10 is a perspective view of a dowel according to an embodiment of the present invention.
Figure 20:
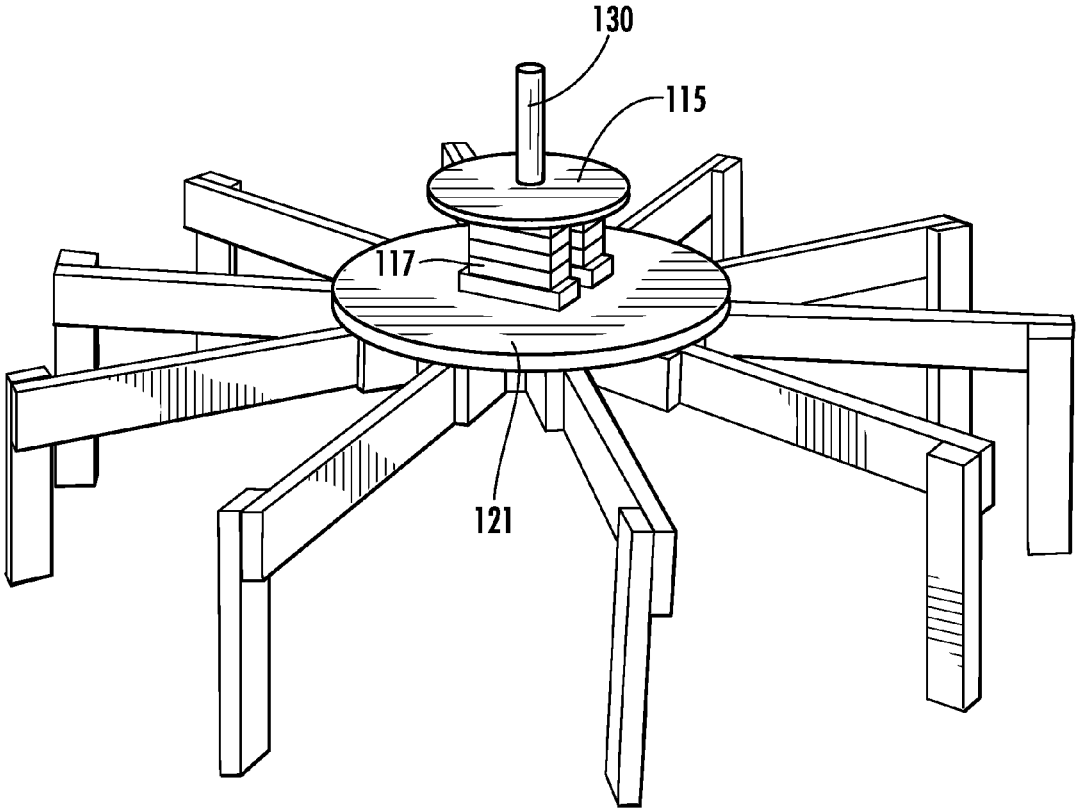
FIG. 20 is a perspective view of the assembly of FIG. 19 with the inner seat attached and dowel inserted according to an embodiment of the present invention.

Inner seat 115 is shown in FIG. 9. Inner seat opening 116 can be substantially centered in inner seat 115. Inner seat opening 116 is optional, but useful for certain other features that require the use of dowel 130, shown in FIG. 10, or a similar element, as described further below. Inner seat opening 116 and dowel 130 should be sized such that inner seat opening 116 can receive dowel 130. For assembly, as illustrated in FIG. 20, inner seat 115 is affixed to seat mounts 117. Inner seat 115 should be positioned on seat mounts 117 such that, if dowel 130 is inserted in inner seat opening 116 (FIG. 9), dowel is also received by mounting assembly top opening 124 (FIG. 5) and rests at one end on mounting assembly base 129.

Figure 11:
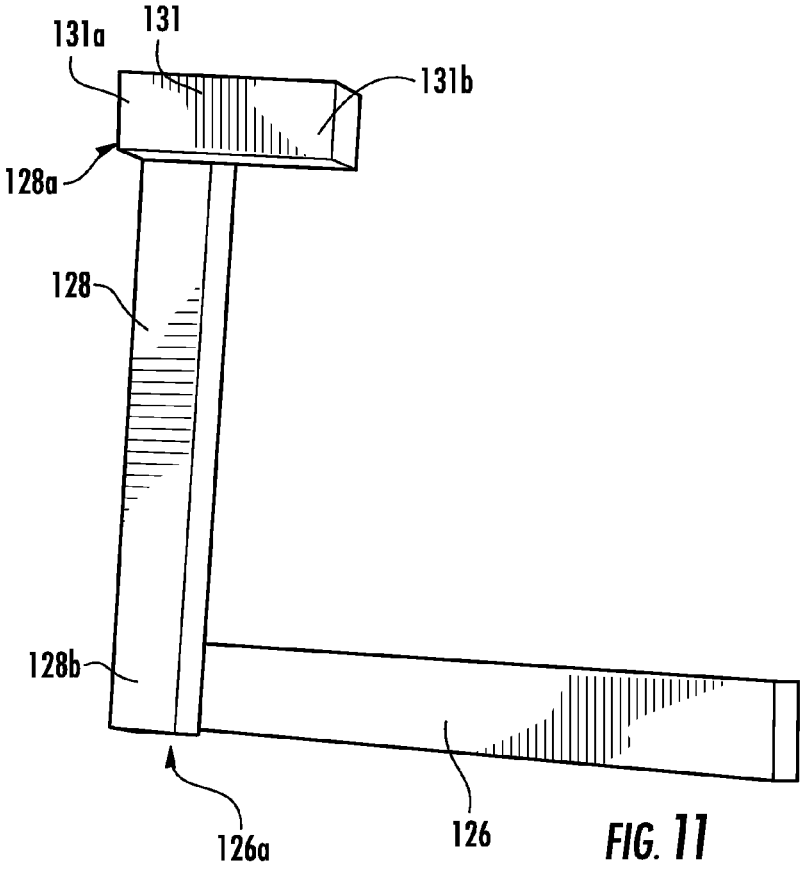
FIG. 11 is a perspective view of a table top brace comprising a vertical table top brace, a horizontal table top brace and a lower horizontal seat brace according to an embodiment of the present invention.

A series of braces including horizontal table top brace 131, vertical table top brace 128 and lower horizontal seat brace 126 are shown in FIG. 11. For transport and storage, horizontal table top brace 131 and lower horizontal seat brace 126 can be rotatably attached to opposing ends of vertical table top brace 128 such that each of horizontal table top brace 131 and lower horizontal seat brace 126 can rotate at least between zero degrees)(0° (retracted position) and ninety degrees)(90° (extended position) with respect to vertical table top brace 128. For transport and storage, both horizontal table top brace 131 and lower horizontal seat brace 126 can be kept in the retracted position. In use, end 131*a* of horizontal table top brace 131 is rigidly affixed to vertical table top brace 128 at its first end 128*a* in the extended position and first end 126*a* of lower horizontal seat brace 126 is rigidly affixed to vertical table top brace 128 at its second end 128*b* in its extended position.

Figure 21:
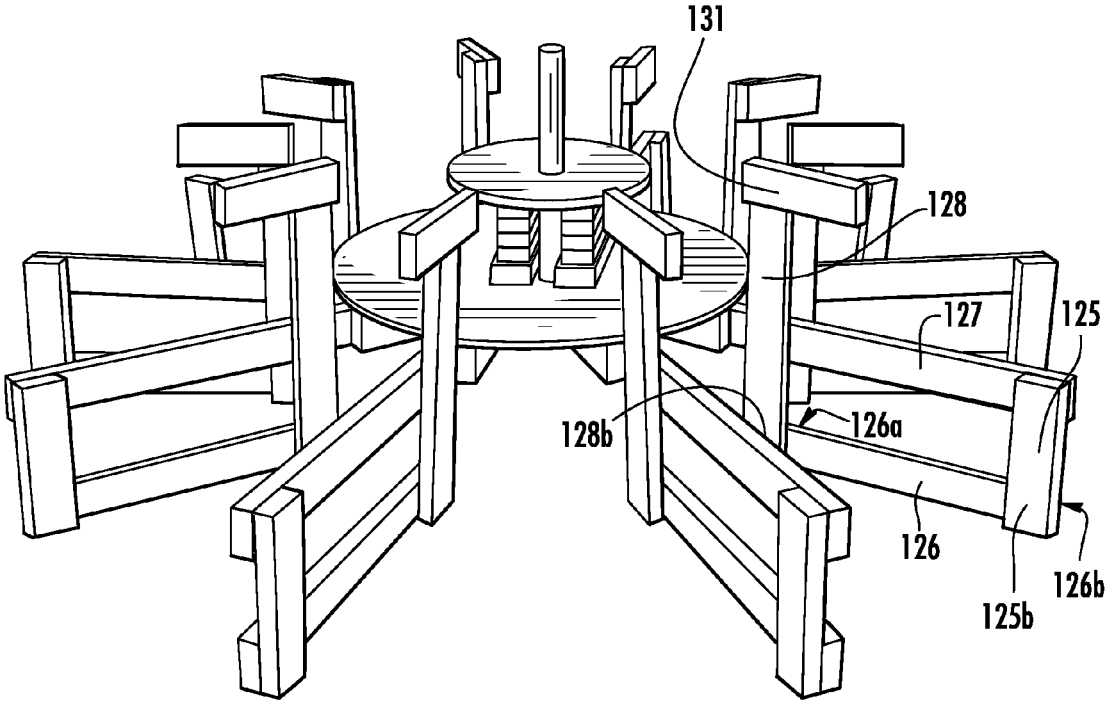
FIG. 21 is a perspective view of the table top brace of FIG. 11 affixed to the assembly of FIG. 20 according to an embodiment of the present invention.

For assembly, as shown in FIG. 21, lower horizontal seat brace 126 is positioned substantially perpendicularly to vertical seat brace 125 and second end 126*b* of lower horizontal seat brace 126 is fixedly attached to second end 125*b* of vertical seat brace 125. Lower horizontal seat brace 126 is positioned parallel to and below upper horizontal seat brace 127. For additional security, vertical table top brace 128 can be fixedly attached to upper horizontal seat brace 127.

Figure 12:
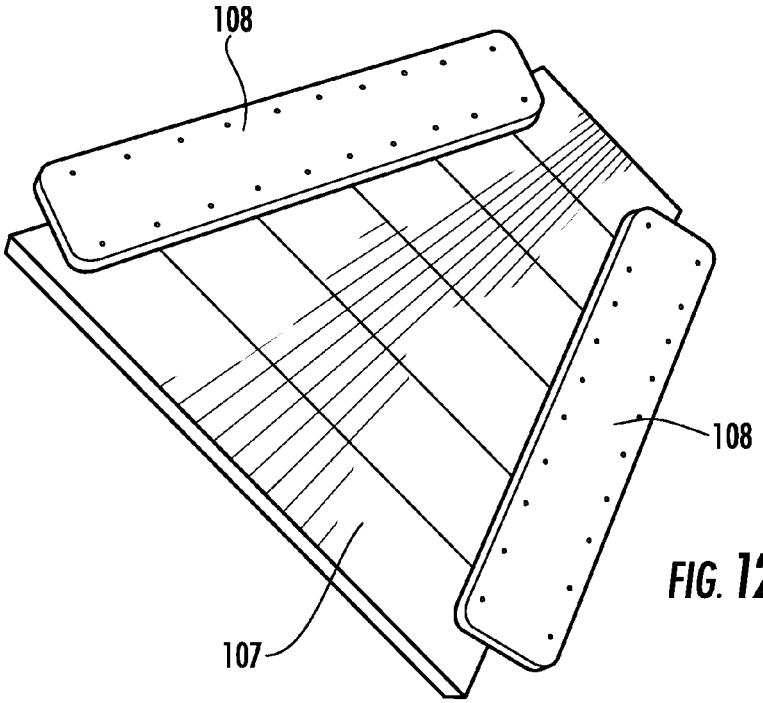
FIG. 12 is a perspective view of the bottom side of a table top portion having table top side attachment members according to an embodiment of the present invention.
Figure 13:
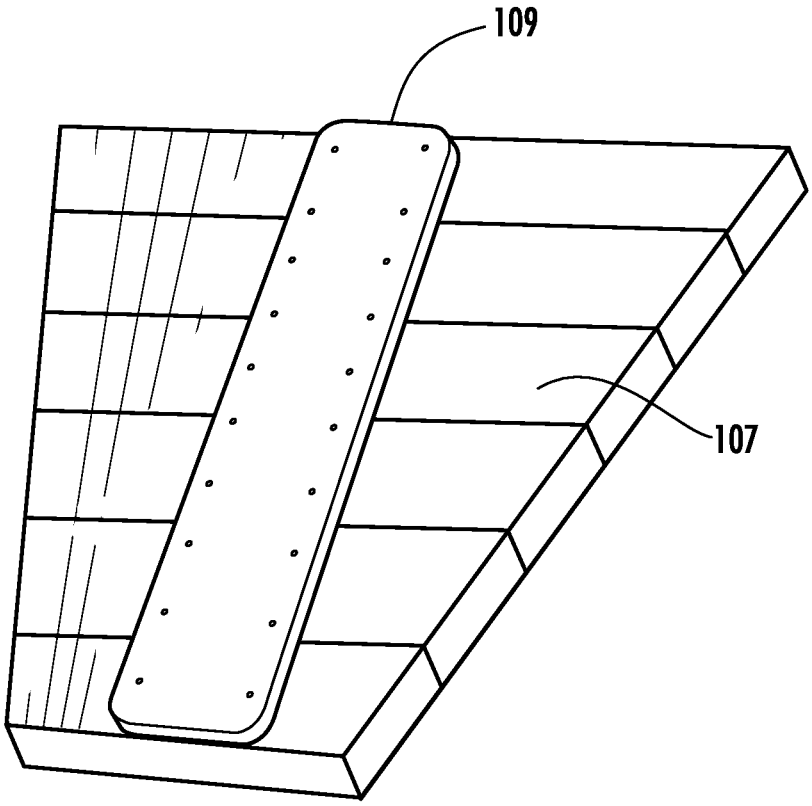
FIG. 13 is a perspective view of the bottom side of a table top portion having a table top center attachment member according to an embodiment of the present invention

Table top portions 107*a-j* are of substantially the same size and shape. As such, representative table top portion 107 is shown in FIGS. 12 and 13. FIGS. 12 and 13 are views of the bottom side of table top portions 107. Views of the top side of table top portions 107*a-j* can be readily seen in FIGS. 1, 2 and 3. Table top portions 107*a*, 107*c*, 107*e*, 107*g* and 107*i* can include table top side attachment members 108 as shown in FIG. 12 to assist in affixing table top portions 107*a-j* to corresponding horizontal table top braces 131. Table top center attachment member 109, as shown in FIG. 13, can be used on the remaining table top portions (107*b*, 107*d*, 107*f*, 107*h*, and 107*j*). Table top center attachment member 109 can be used to attach together the boards that comprise table top portion 107. However, other materials can be used for table top portion 107 or other affixing means can be used eliminating the need for table top center attachment member 109.

Figure 22:
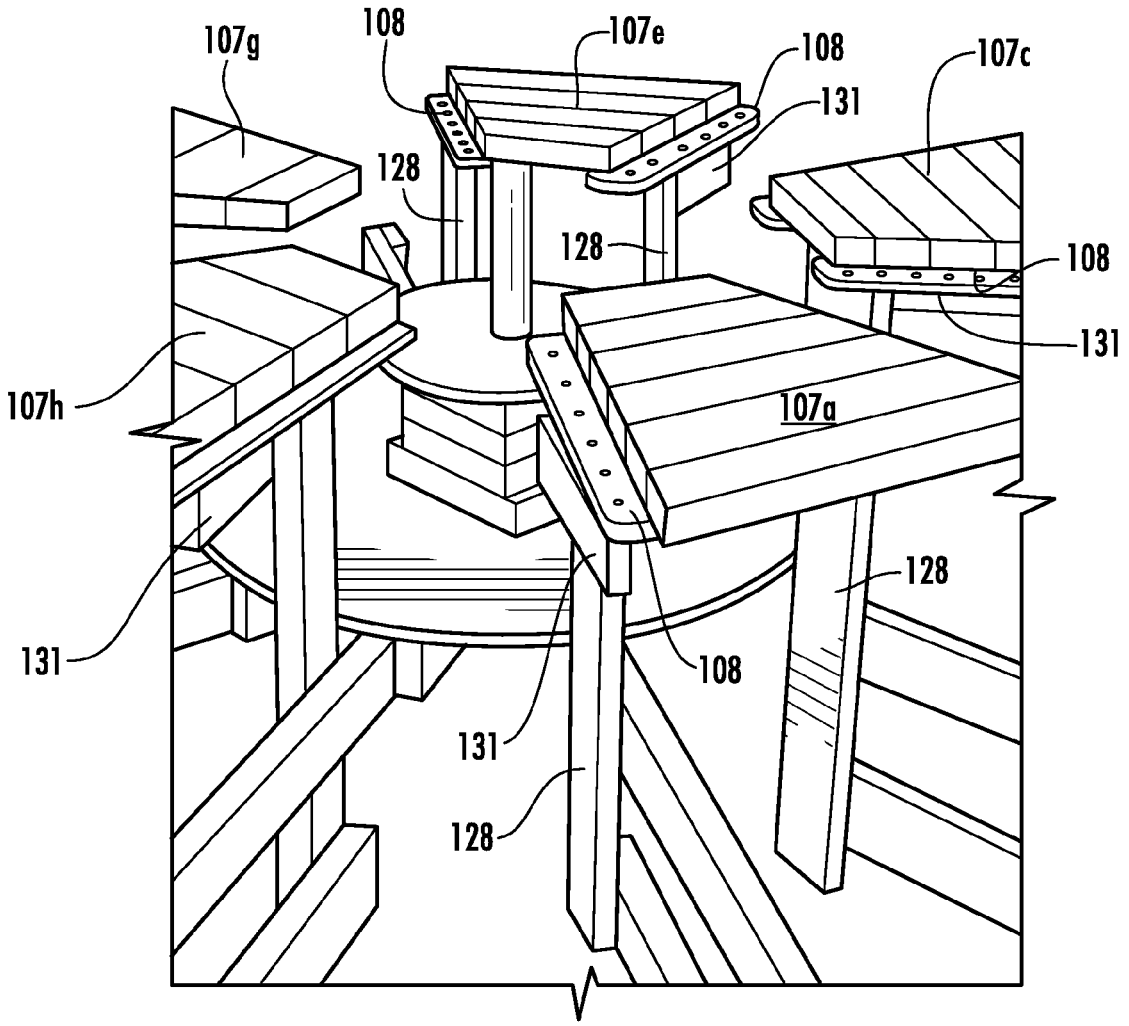
FIG. 22 is a perspective view of the assembly of FIG. 21 with a plurality of the table top portions of FIG. 12 affixed thereon according to an embodiment of the present invention.
Figure 23:
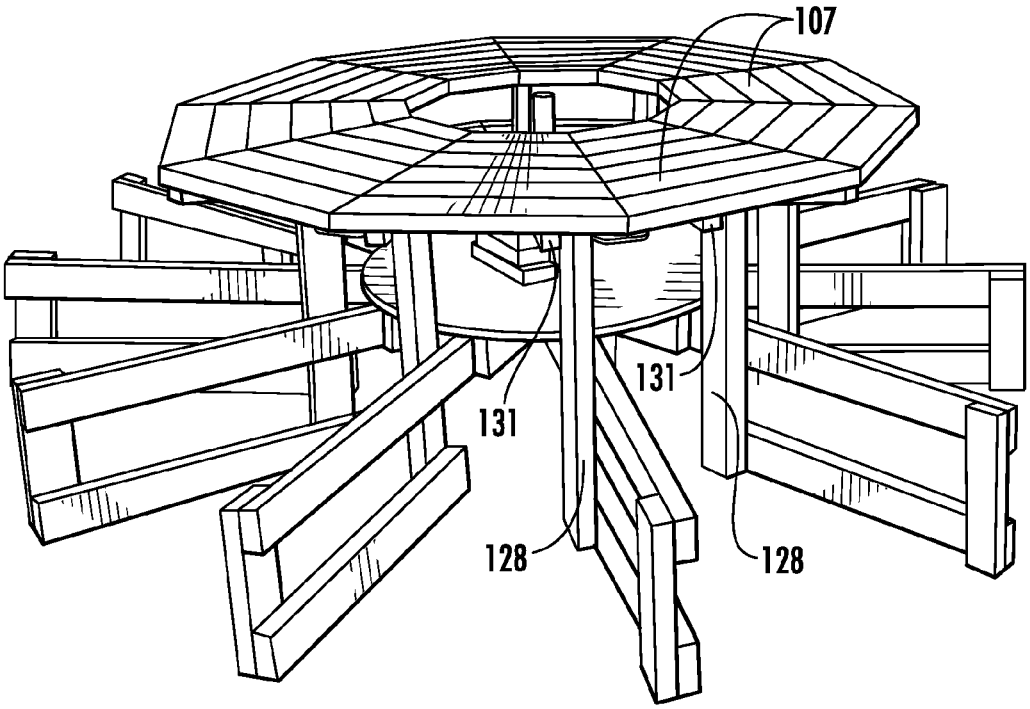
FIG. 23 is a perspective view of the assembly of FIG. 22 with a plurality of the table top portions of FIG. 13 affixed thereon according to an embodiment of the present invention.

For assembly, as shown in FIG. 22, table top portion 107*a* is positioned on adjacent horizontal table top braces 131. Table top side attachment members 108 are rigidly affixed to horizontal table top brace 131. Table top portions 107*c*, 107*e*, 107*g* and 107*i* can be similarly attached. Once table top portions 107*a*, 107*c*, 107*e*, 107*g* and 107*i* are affixed to corresponding adjacent horizontal table top braces 131, table top portions 107*b*, 107*d*, 107*f*, 107*h* and 107*j* can then be positioned in between adjacent table top portions 107*a*, 107*c*, 107*e*, 107*g* and 107*i* and affixed to the corresponding table top side attachment members 108 of table top portions 107*a*, 107*c*, 107*e*, 107*g* and 107*i*, as shown in FIG. 23.

Alternatively, table top portions 107 can be directly affixed directly to horizontal table top braces 131. Horizontal table top braces 131 may be made wider to make this alternative practicable.

Figure 14:
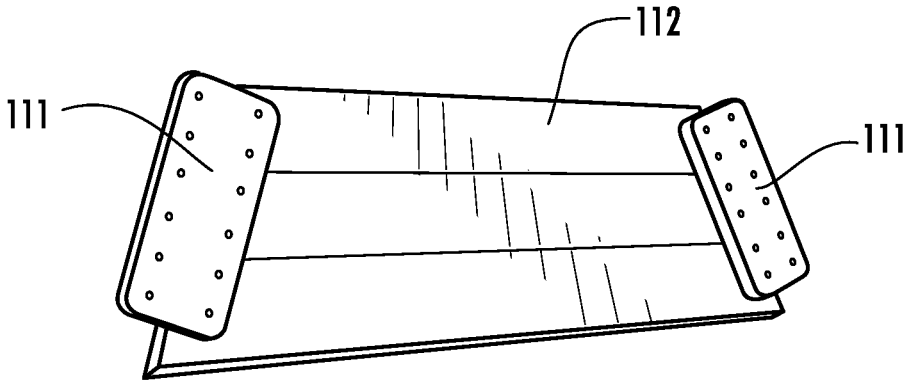
FIG. 14 is a perspective view of the bottom side of an outer seat portion having seat side attachment members according to an embodiment of the present invention.
Figure 15:
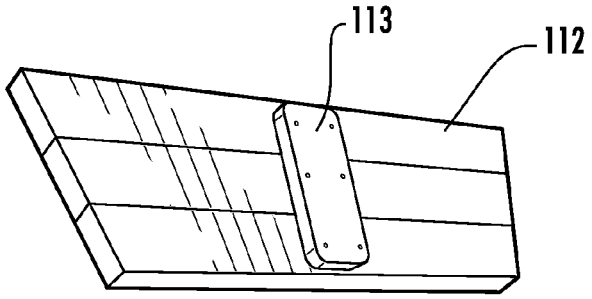
FIG. 15 is a perspective view of the bottom side of an outer seat portion having a seat center attachment member according to an embodiment of the present invention.

Outer seat portions 112*a-j* are of substantially the same size and shape. As such, representative outer seat portion 112 is shown in FIGS. 14 and 15. FIGS. 14 and 15 are views of the bottom side of outer seat portion 112. Views of the top side of outer seat portions 112*a-j* can be readily seen in FIGS. 1, 2 and 3. Outer seat portions 112*a*, 112*c*, 112*e*, 112*g* and 112*i* include seat side attachment members 111 as shown in FIG. 14. Seat center attachment member 113, as shown in FIG. 13, can be used on the remaining outer seat portions (112*b*, 112*d*, 112*f*, 112*h* and 112*j*). Seat center attachment member 113 can be used to attach together the boards that comprise outer seat portion 112. However, other materials can be used for outer seat portion 112 or other affixing means can be used eliminating the need for seat center attachment member 113.

Figure 24:
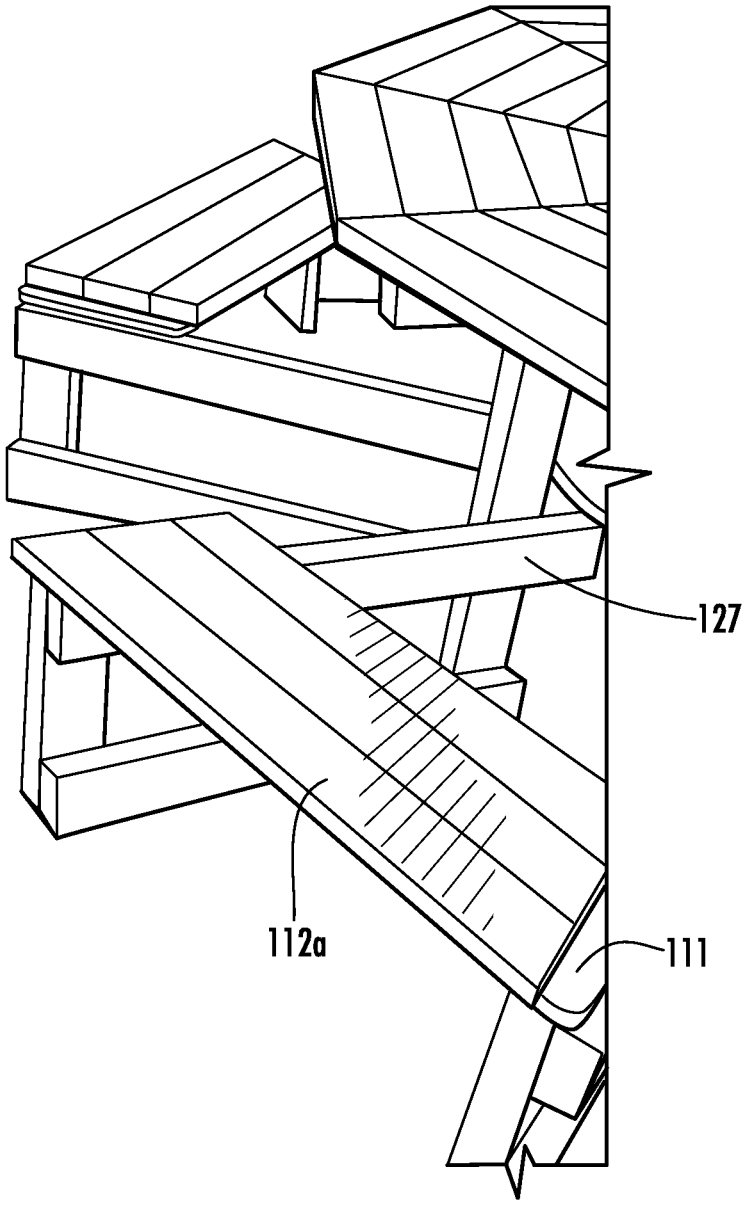
FIG. 24 is a perspective view of the assembly of FIG. 23 with a plurality of the outer seat portions of FIG. 14 affixed thereon according to an embodiment of the present invention.

For assembly, as shown in FIG. 24, outer seat portion 112*a* is positioned on adjacent upper horizontal seat braces 127. Seat side attachment members 111 are rigidly affixed to horizontal seat braces 127. Outer seat portions 112*c*, 112*e*, 112*g* and 112*i* can be similarly attached. Once outer seat portions 112*a*, 112*c*, 112*e*, 112*g* and 112*i* are affixed to corresponding adjacent upper horizontal seat braces 127, outer seat portions 112*b*, 112*d*, 112*f*, 112*h* and 112*j* can then be positioned in between adjacent outer seat portions 112*a*, 112*c*, 112*e*, 112*g* and 112*i* and affixed to the corresponding seat side attachment members 111 of outer seat portions 112*a*, 112*c*, 112*e*, 112*g* and 112*i*, as shown in FIG. 1.

Figure 29:
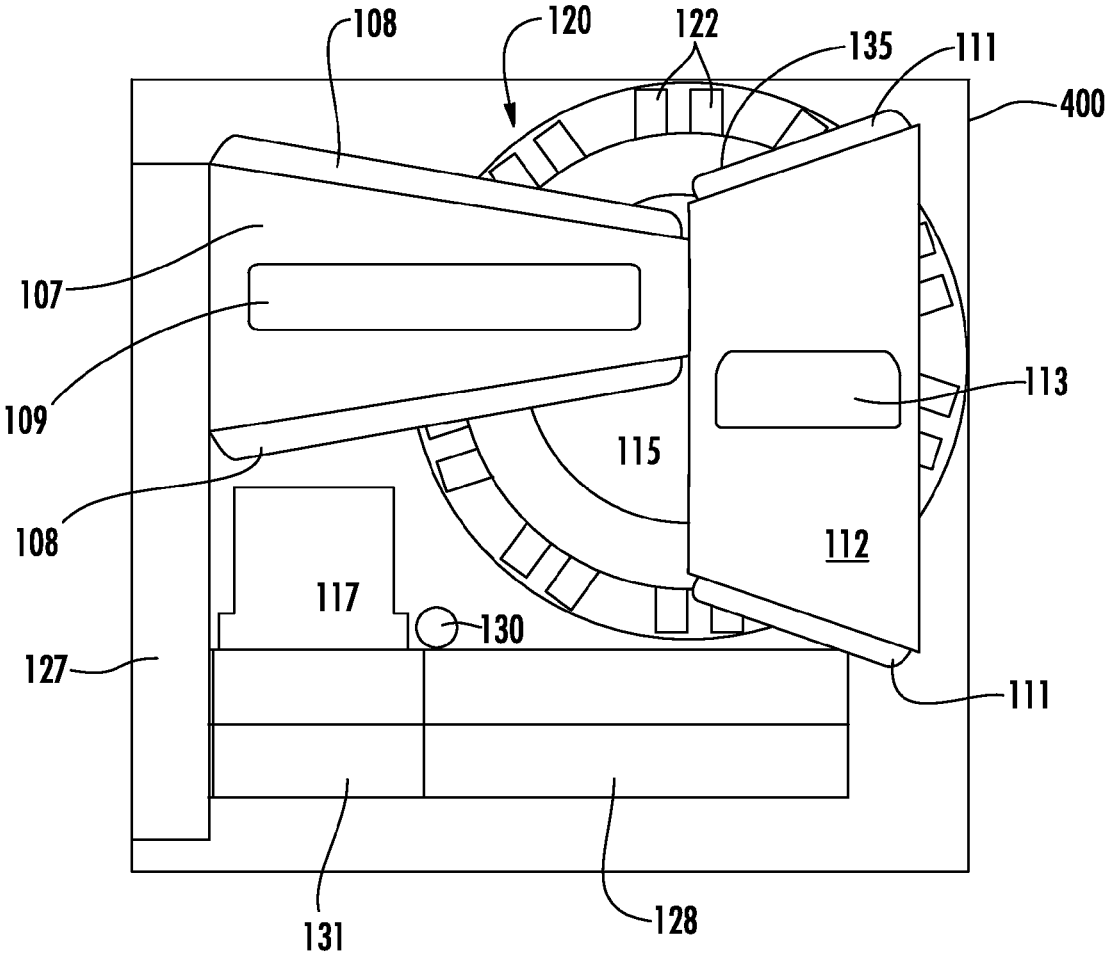
FIG. 29 is a top plan view of example placement of the elements that comprise a table with inner row seating for storage and transport according to an embodiment of the present invention.

The elements of table 100 can be stacked and placed together in the exemplary manner shown in FIG. 29 for ease in transporting table 100. FIG. 29 is a top plan view and as such not all elements can be seen. Upper horizontal seat braces 127 and vertical seat brace 125 (not visible) are in their retracted position and are stacked near a first side of pallet 400. Horizontal table top braces 131 and lower horizontal seat braces 126 (not visible) are in their retracted positions with respect to vertical table top braces 128 and are stacked near a second side of pallet 400. Center mounting assembly 120 is positioned top-side down near a third and fourth side of pallet 400. Mounting assembly base 129 (not visible) is positioned inside center mounting assembly 120 in the center of brace positioning members 122. Revolving tray 135 is positioned on top of mounting assembly 120 and inner seat 115 is positioned on top of revolving tray 135. Outer seat portions 112 are stacked on top of center mounting assembly 120 and near the third side of pallet 400. The top outer seat portion of the stack of outer seat portions 112 includes seat center attachment member 113. Seat side attachment portion 111 from an outer seat portion lower in the stack is visible. Table top portions 107 are stacked on pallet 400 between outer seat portions 112 and upper horizontal seat brace 127. The top table top portion of the stack of table top portions 107 includes table top center attachment member 109. Table top side attachment member 108 from a table top portion lower in the stack is visible. Seat mounts 117 can be stacked on top of each other and positioned on the interior of pallet 400 as shown. Similarly, dowel 130 can be placed on the interior of pallet 400.

Figure 25:
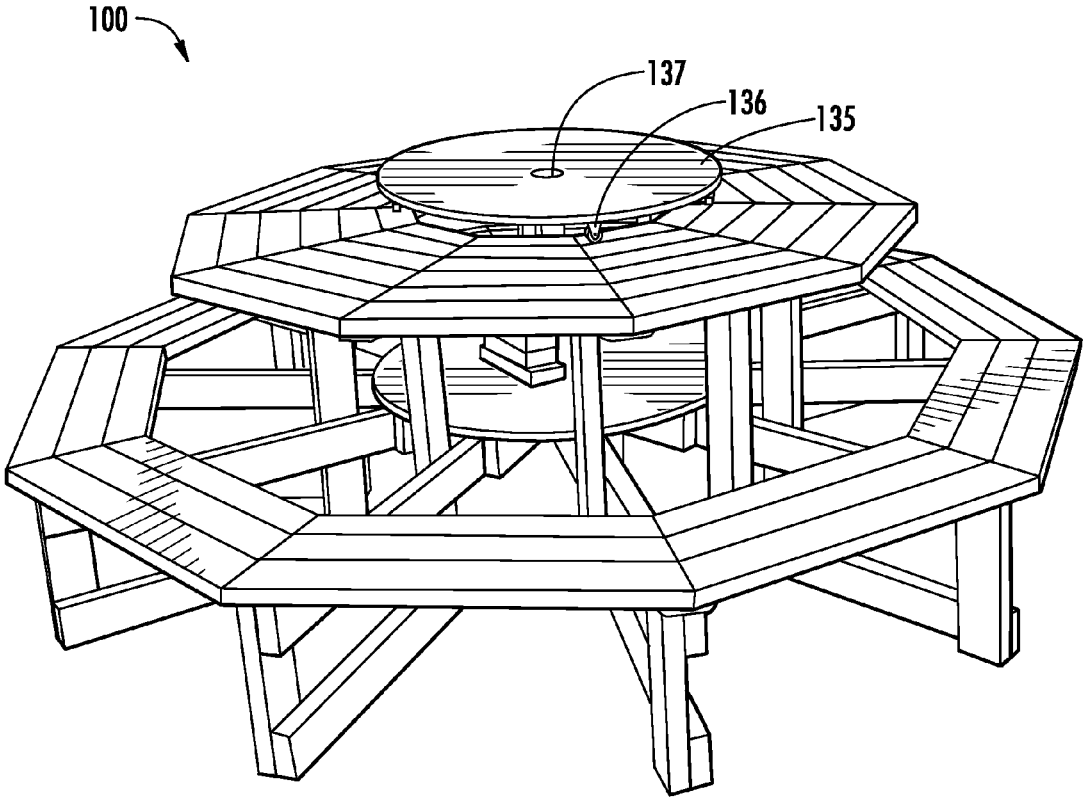
FIG. 25 is a perspective view of the table of FIG. 1 with a revolving tray positioned thereon according to an embodiment of the present invention.

As shown in FIG. 25, table 100 can also include removable revolving tray 135. Dowel 130 (not shown) can be inserted into inner seat opening 116 (not shown) as described above. Removable revolving tray 135 can include opening 137 that is sized to receive at least a portion of dowel 130. Alternatively, revolving tray 135 can include a receiving cavity instead of opening 116 to receive a portion of dowel 130. The receiving cavity can be formed in removable revolving tray 135 or an element positioned on revolving tray 135. Dowel 130 can then act as an axel for revolving tray 135 to rotate about. Wheels 136 positioned on bottom of revolving tray 135 allow revolving tray 135 to rotate.

While the embodiments shown utilize separate table top portions 107*a*-107*j*, a singular piece could be used for all but the removable portion of table top 105. Similarly, although separate outer seat portions 112*a*-112*j* are shown, a singular piece could be used for all but the removable portion of outer seating 110. Likewise, other elements that are rigidly affixed to one another can be formed from a singular piece. Although picnic tables are often made from wood, the embodiments shown can be made from other known materials, including plastic.

Figure 26:
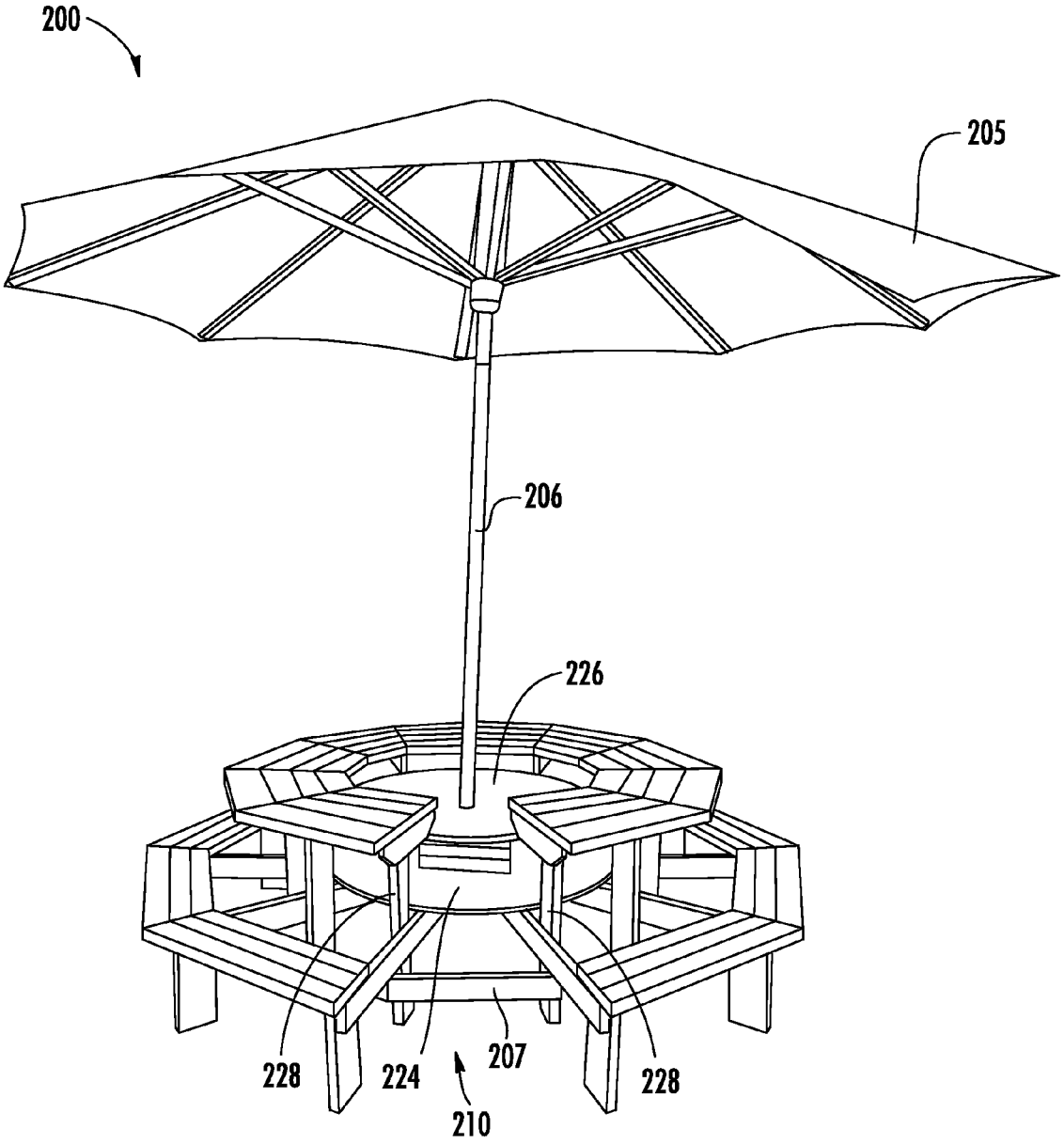
FIG. 26 is a perspective view of a table with inner row seating having an open entry to the inner row seating, an umbrella coupled thereto, and a step to access the inner row seating according to an embodiment of the present invention.

As shown in FIG. 26, table 200 can include umbrella 205. Umbrella pole 206 is received by an opening (not shown) in inner seat 216 and an opening (not shown) in mounting assembly top 224 and can rest on the mounting assembly base (not shown), if present.

Table 200 also includes open entry 210 to the inner row seating and step 207 positioned between vertical table top braces 228.

Figure 27:
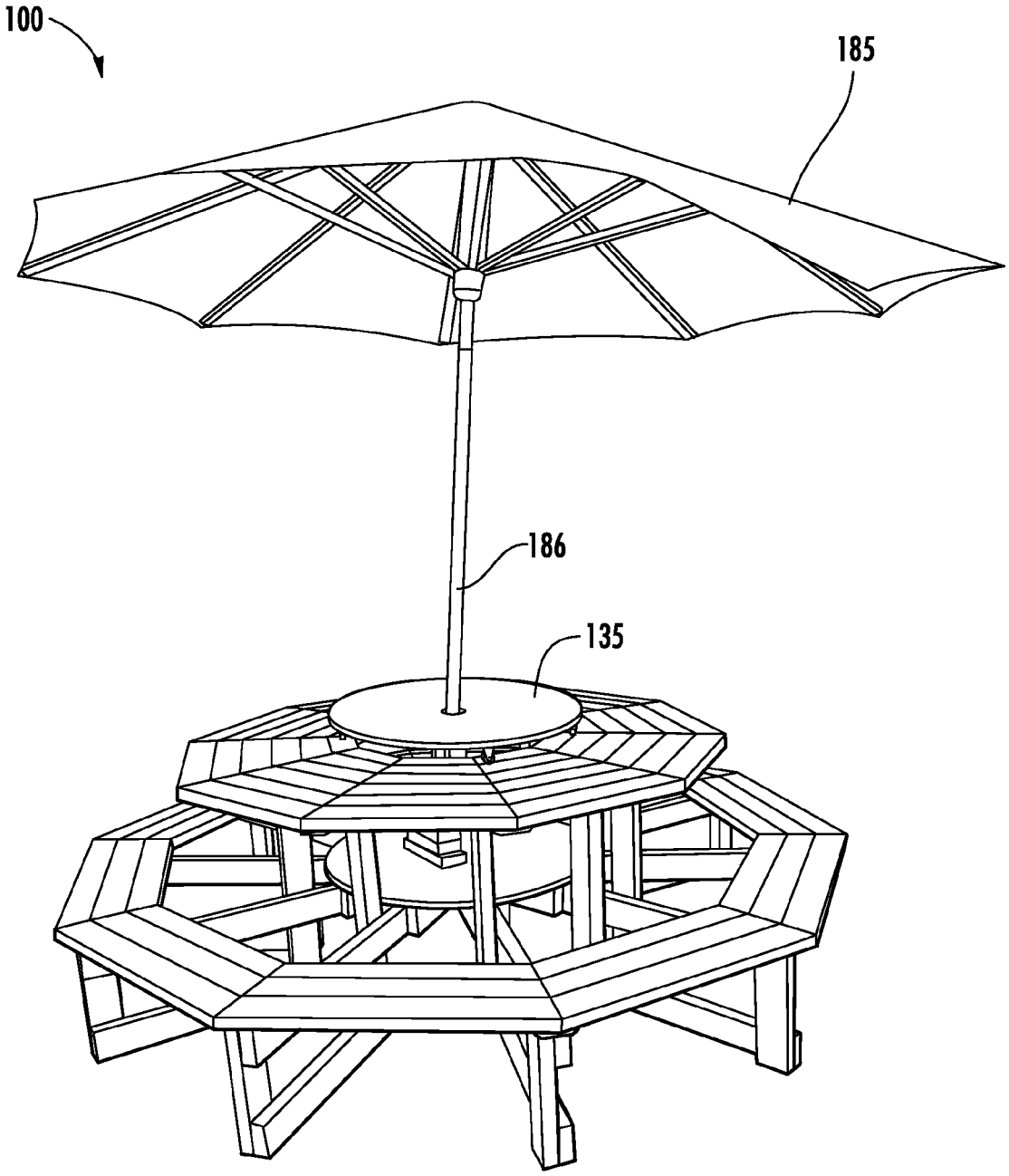
FIG. 27 is a perspective view of a table with inner row seating having a revolving tray positioned thereon and an umbrella coupled thereto according to an embodiment of the present invention.

Table 100 can include both revolving tray 135 and umbrella 185 as shown in FIG. 27. Umbrella pole 186 replaces the dowel 130 and serves as an axel for revolving tray 135 to rotate about.

Figure 28:
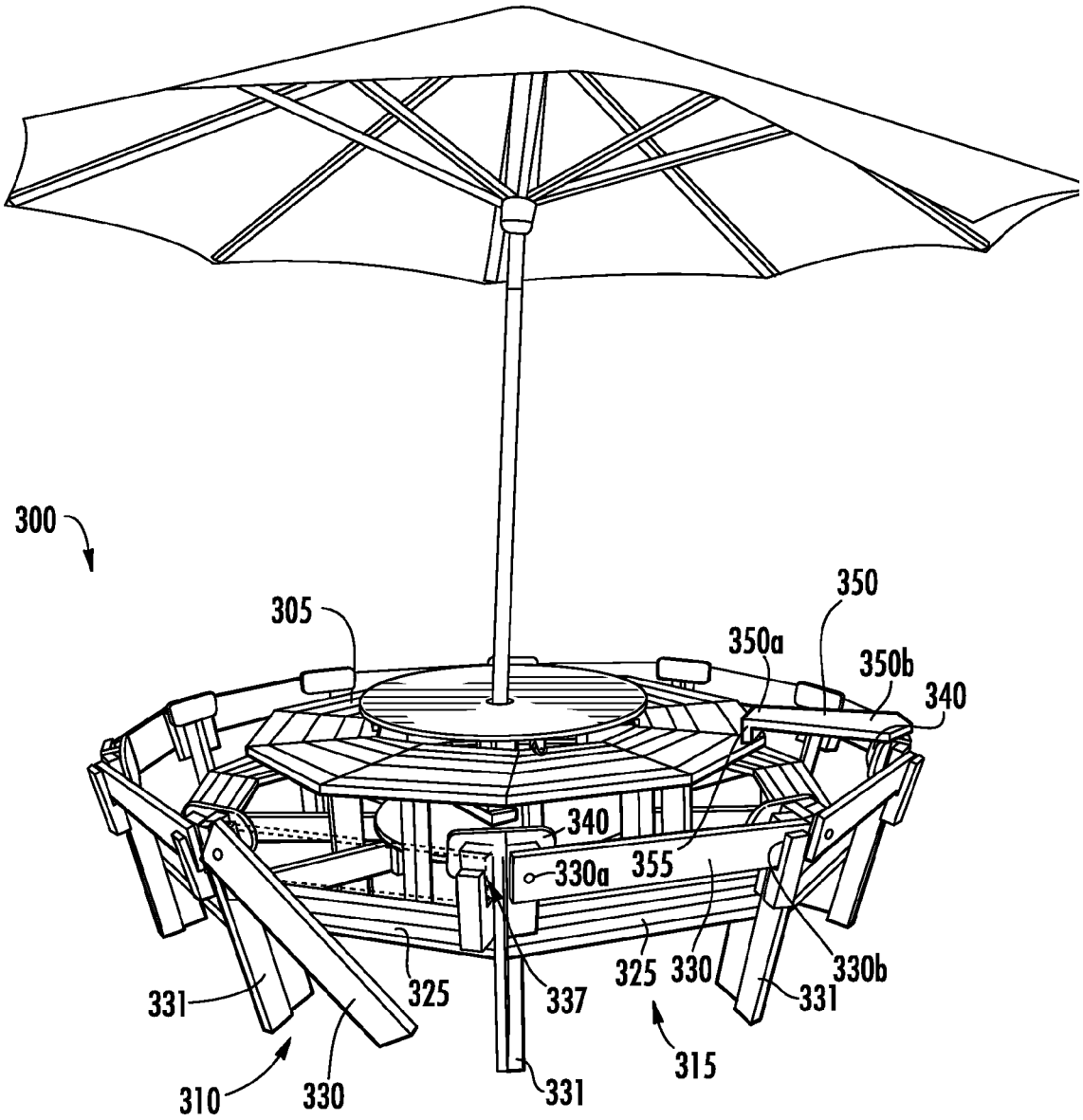
FIG. 28 a perspective view of a table with inner row seating having backrests attached thereto and a table extension positioned thereon according to an embodiment of the present invention.

In FIG. 28, table 300 also comprises back rests 330 and table extension 350. Vertical back rest braces 331 are affixed to corresponding vertical seat braces 332 and extend at a substantially vertical angle above outer seats 325. Back rests 330 are rotatably connected to vertical back rest braces 331 at their first ends 330*a*. Receiving slots 337 affixed to or formed from vertical back rest braces 331 receive second end 330*b* of back rests 330. Back rests 330 can rotate about their rotatable connection with vertical back rest braces 331 from at least a lowered position 310 to a horizontal position 315. Covers 340 may be affixed to vertical back rest braces 331.

Table extension 350 comprises a generally planar surface that extends over outer seating 325 between table top 305 and back rest 330. Front support member 355 affixed to front-side 350*a* of table extension 350 rests on table top 305 and back support member 340 affixed near back-side 350*b* of table extension 350 abuts cover 340 while back-side 350*b* of table extension 350 extends on to and rests on cover 340.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A table comprising:

a plurality of table top portions assembled into a table top having a central opening, wherein at least one of the plurality of table top portions is removable from the table top;

a plurality of substantially vertical table top braces in communication with the plurality of table top portions;

a plurality of substantially horizontal seat braces in communication with the plurality of substantially vertical table top braces;

a plurality of outer seat portions assembled into an outer seat, wherein at least one of the plurality of outer seat portions is removable from the outer seat, and wherein the plurality of outer seat portions are in communication with the plurality of substantially horizontal seat braces;

a center mounting assembly substantially centered within the plurality of substantially vertical table top braces and in communication with the plurality of substantially horizontal seat braces; and an inner seat, having a circumference less than the circumference of the central opening of the table top, mounted on the center mounting assembly.

2. The table of claim 1, wherein the plurality of table top portions are substantially identical in shape and size.

3. The table of claim 1 further comprising:

a plurality of substantially vertical seat braces in communication with the plurality of outer seat portions and extending substantially perpendicularly therefrom.

4. The table of claim 1, wherein the table top portions are substantially trapezoidal in shape.

5. The table of claim 1, wherein the assembled table top forms a substantially polygonal shape.

6. The table of claim 1, wherein the assembled outer seat forms a substantially polygonal shape.

7. The table of claim 1, further comprising:

a first opening substantially in the center of the inner seat; and a second opening substantially in the center of a top of the center mounting assembly; and wherein the first and second opening are substantially along the same axis.

8. The table of claim 7, further comprising:

a dowel positioned in the first and second openings; and a revolving tray positioned above the table tap and in communication with the dowel.

9. The table of claim 7, further comprising:

an umbrella having an umbrella pole, wherein the first opening and the second opening are sized to receive the umbrella pole.

10. The table of claim 1, further comprising:

a first and a second substantially vertical backrest brace in communication with the a first and a second substantially vertical seat brace of the plurality of substantially vertical seat braces, wherein the second substantially vertical backrest brace comprises a receiving slot; and a backrest having a first and a second end, wherein the first end of the backrest is rotatably affixed to the first substantially vertical backrest brace and the second end of the backrest is sized to enter the receiving slot.

* * * * *